US005671581A

United States Patent [19]

Nagahama

[11] Patent Number: 5,671,581

[45] Date of Patent: Sep. 30, 1997

[54] WATER CUT-OFF PROCESS FOR CONCRETE STRUCTURE

[76] Inventor: Shigeo Nagahama, 341-1, Aza-Ishizaki, Kaminokuni-Cho, Hiyama-Gun, Hokkaido, Japan

[21] Appl. No.: 568,995

[22] Filed: Dec. 7, 1995

[30] Foreign Application Priority Data

Dec. 7, 1994 [JP] Japan ..... 6-303801

[51] Int. Cl.[6] ..... E04G 23/00

[52] U.S. Cl. ..... 52/741.41; 52/514.5; 52/741.4

[58] Field of Search ..... 52/514, 514.5, 52/741.4, 741.41, 742.14, 741.1, 742.13, 742.16

[56] References Cited

U.S. PATENT DOCUMENTS

| | | | |
|---|---|---|---|
| 1,883,196 | 10/1932 | Wertz | 52/514 |
| 2,187,324 | 1/1940 | Many | 52/742.14 |
| 2,229,264 | 1/1941 | Wertz | 52/742.14 |
| 2,761,305 | 9/1956 | Davis . | |
| 3,572,956 | 3/1971 | Liscum | 52/742.16 |
| 4,352,262 | 10/1982 | Edelmann et al. | 52/742.16 |
| 4,744,193 | 5/1988 | Hatsuzaki et al. | 52/742.16 |
| 5,186,949 | 2/1993 | Lai | 52/514 |
| 5,226,279 | 7/1993 | Rendon-Herrero | 52/741.41 |
| 5,253,957 | 10/1993 | Fujikawa . | |

FOREIGN PATENT DOCUMENTS

| | | |
|---|---|---|
| 1165726 | 10/1958 | France . |
| 546413 | 12/1987 | Japan . |

*Primary Examiner*—Michael Safavi

*Attorney, Agent, or Firm*—Knobbe, Mertens, Olson & Bear, LLP

[57] ABSTRACT

A method of preventing water leakage through a concrete substrate on the ground into an inner space of an underground structure. Underground structures located adjacent water tables maybe sealed against the intrusion of water as by drilling an opening to the outer side of the concrete substrate. A pipe possessing a valve is then inserted with the valve in a cut-off position to stem the flow of water leaking through the substrate. Cement slurry is then inserted through the pipe into the opening until a portion of the cement is in place along the outer side of the concrete substrate adjacent the ground. An inner end of the pipe is then cut away with the cement slurry being allowed to dry for approximately one day. Unhardened cement is removed from the pipe from which water is still leaking. A cement powder is heaped upon the opening and is compacted into the opening via an impacting hammer. After necessary repeated filling and impacting of the cement powder the inner side of the concrete substrate is finished with a cement paste.

10 Claims, 2 Drawing Sheets

WATER CUT-OFF PROCESS FOR CONCRETE STRUCTURE

BACKGROUND OF THE INVENTION

1. Field of the Invention

The present invention relates to a cut-off water process for cutting off underground-water leaking from a concrete wall into an inner space of an underground structure such as a tunnel, sewageworks, pipe utility conduit, a fire preventive water tank, a cellar and the like.

In the recent urban districts deep-underground (geo-front) structures have increasingly been constructed, while water-leakage into the underground structure has accordingly become a serious problem. Inherently cities are developed along river basins in any countries. For example, in Tokyo urban areas are formed both sides of many rivers such as the Sumida River, the Edo River, and so on. In addition there are complex underground water veins around such rivers. Furthermore, there are many factors causing water-leakage in the deep underground structures such as underground facilities of waterworks and sewageworks, new underground water veins emerging due to a concentrated heavy rain water obstructed by a ground surface or underground structures, and the like.

Against such water leakage upon the cause of construction such a concrete underground structure, various cut-off water methods have certainly been taken in advance, for example to joint and crack portions of a concrete structure and the like. As other existing cut-off water methods, there are methods having the following steps: cutting off a concrete portion at water leakage portion of the existing structure in a V or U shaped manner; filling up or applying with a cut-off water materials in the said V or U shaped cut portions, and a cut-off water method by filling up joints and cracks in the water leaking surface side with any other swelling resins. However, even if such temporary cut-off water treatments or mending works had been done and were successful, in the lapse of time or by the vibrations thereafter water leakage would often emerge at the same portions again. Furthermore, by repeating such mending works said V or U shaped cut portions would be enlarged, which causes the strength of the concrete wall of the underground structure to be weakened.

2. Description of the Related Art

In order to solve a problem as mentioned above, the inventor of the present application developed, as a cut-off water system, a method for grouting in water leaking portions with cement slurry under low pressure (refer to JP-B-5046413). According to this method the concrete wall of a underground structure such as a tunnel and the like is firstly provided with a through-hole extending from the inside to the outside thereof at the water leaking portions. Then a pipe is inserted into the through-hole, said pipe having a valve. For the purpose of cutting off a large amount of spouting water, the valve of the pipe is temporarily shut off before cement slurry is grouted through the charging end of the pipe into the through-hole under pressure of 3–5 kg/cm$^2$ by a grouting pump to push out into the opposite outer void of the concrete wall. Finally cement slurry is mixed with an accelerating agent, and cement particles are adhered to the water leakage portions of the outer surface of the concrete wall by water pressure to form a cement hardened layer extending over some extent of area of the outer surface whereby water leakage is cut off.

After the grouted cement has hardened, the end of the pipe inwardly protruding from the inner surface of the concrete wall is cut away, and the inner surface is finished with finishing material in even surface level of concrete wall. Thus the cut-off water work is completed. However, when cement is not sufficiently hardened or a certain water leakage is still emerged, it is required to completely cut off the water leakage again.

SUMMARY OF THE INVENTION

The object of the present invention is to provide with a process for completely cutting off water leakage, after which any water leakage would never emerge.

In order to achieve this object, a cut-off water process for a concrete underground structure according to the present invention comprises the following steps; drilling a through-hole extending from the inside to the outside of a concrete wall of said underground structure at each water-leaking portion thereof, respectively; inserting a pipe into said respective through-hole, each pipe including a valve; temporarily interrupting a large amount of water spouting from a charge end of said pipe by shutting off said valve; grouting cement slurry under low pressure through said pipe into said through-hole and pushing out into the outer void of said concrete wall in the underground by a grouting pump, while mixing an accelerating agent into said cement slurry and adhering cement particles onto said outer surface of said concrete wall at said water leaking portion whereby said outer surface of said concrete wall is formed with a cement hardened layer extending over some extent of area; and cutting away the end of said pipe inwardly projecting from said inner surface of said concrete wall toward the inner space of said underground structure: wherein said process further comprising the following steps; leaving the work about for one day as it is; removing unhardened cement in the spout of said cut-out pipe, from which water is still leaking; filling cement powder, preferably mixed with a cohesive filler and an accelerating agent, if desired, with the help of a cement filling gun to push out into the spout of said pipe and into said through-hole so as to heap up powder thereon; imparting a strong impacting stress by an impacting tool or a hammer toward said filled cement powder from the inside of said concrete wall to consolidate and tightly fill it up into the spout of said pipe and said through-hole; repeating several times such an operation around the said spout of pipe leaking portion; and finally finishing the inner surface of said concrete wall at said water leaking portion with cement paste.

In case of a large amount of spouting water it is preferred to mix a required amount of clay as a cohesive filler into the pipe with pressure before the step of filling cement powder. After cement powder is filled with the help of a filling gun to form a heap thereon, a strong impacting stress is applied to said filled and heaped cement powder by an impacting tool or a hammer. In case that water leakage portion is extended along a crack of the concrete wall, it is preferred to use sodium alginate (industrial laver) powder as a cohesive agent mixed with said cement powder for full penetration.

BRIEF DESCRIPTION OF THE DRAWINGS

The present invention will now be explained in further detail hereinafter, by referring to the preferred embodiment illustrated in the accompanying drawings, wherein.

DETAILED DESCRIPTION OF TEE PREFERRED EMBODIMENTS

Figure 1:
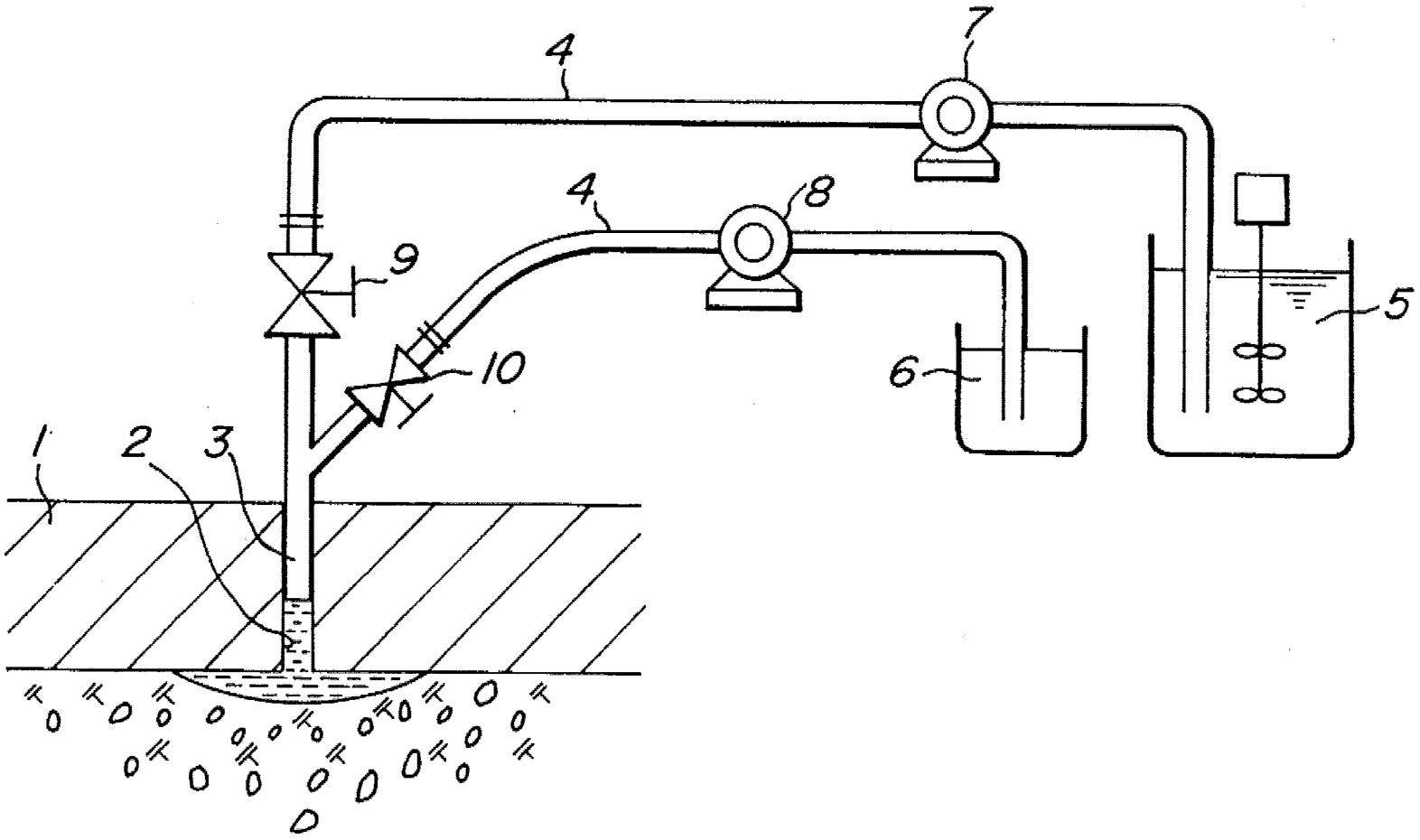
FIG. 1 is a schematically illustrated view at the first stage of cut-off water work according to a process of the present invention.
Figure 2:
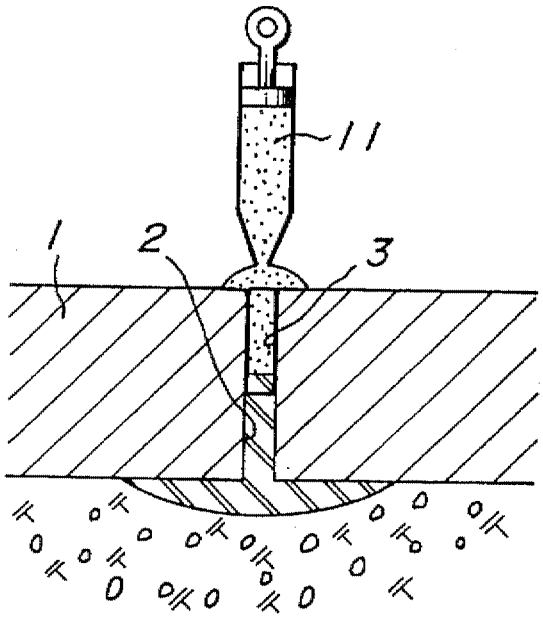
FIG. 2 is a schematically illustrated view at the step of filling up with cement powder with the help of a cement filling gun according to a process of the present invention.
Figure 3:
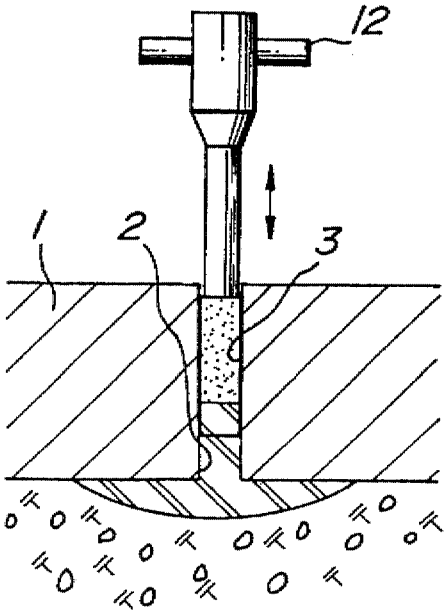
FIG. 3 is a schematically illustrated view at the step of compacting cement powder by a compacting tool or a hammer according to a process of the present invention.

Referring now to FIG. 1, a cut-off water method for a concrete underground structure according to the present invention is hereinafter described. According to the process of the present invention, the concrete wall 1 of the underground structure is provided with a through-hole 2 extending from the inside to the outside of the concrete wall at water leakage portion. A pipe 3 is inserted into the through-hole 2, said pipe 3 connected to hoses 4 which supply the through-hole 2 from a slurry mixed tank 5 and an accelerating agent tank 6 through grouting pumps 7, 8 and valves 9, 10 with a mixture of the cement slurry and the accelerating agent at a predetermined mixing ratio through the pipe 3 to form a hardened cement layer on the outer surface of the concrete wall 1 spreading over some extent of grouting area. Hereinafter, "outer" and "inner" are defined in the direction from the concrete wall 1 to the ground, i.e., the surface of the concrete wall touching or facing the ground is the outer surface. The cement mixture introduced through the pipe is allowed to stand for approximately one day. The end of pipe 3 projecting from the inner surface of the concrete wall 1 is cut off at the inner surface of the concrete wall 1. If water leakage from the cut off pipe is observed, the unhardened cement mixture packed in the pipe and the through-hole is removed therefrom. A mound of a separately prepared cement power containing an accelerating agent is then packed over the pipe using a cement filling gun 11, as shown in FIG. 2. A high-impact pressure is applied to the packed cement powder in the outward direction, using an impacting tool 12 such as an electric pick hammer or a pneumatic hammer, as shown in FIG. 3, thereby tightly compacting the cement power in the through-hole. The above packing process is repeated, and thereafter, the packed through-hole is finished with a cement paste to level it off.

The type of cement firstly grouted as cement slurry may be varied according to the water leakage conditions. For example, at the portion where a water leakage rate is very small and in such an extent that a small amount of water oozes out of the inner surface of the concrete wall, a normal portland cement having a slow setting time is used, and then anyone of sodium bicarbonate group is used together as a hardening accelerator. At the portion where a large amount of water leakage is emerging, more than 100 liter per minute such as spouting water and spring water, super fine particle cement (average size of 4μ) is used together with a weak acid silica sol as an accelerating agent, whereby gelatinization time is shortened within two minutes and cement can be hardened extremely in a short time to effectively cut off the water leakage. In the case of a middle amount of water leakage such as a spring water, super early strength cement (jet cement, so to speak, as one-hour cement) is used together with a setting retarder, whereby the cut-off water effect can be enhanced.

At the portion where a water leakage is spreading over a large extent, and a very large amount of water is leaking, necessary numbers of suitable masses of rounded clay are firstly pressed into the water leaking portion, and thereafter cement powder is filled up with the help of a filling gun and is heaped on the inner surface of the concrete wall, while the filled cement is strongly compacted by an impacting tool or a hammer. Further at the portion where a water leakage extends along a crack of the concrete wall, a mixture of cement and industrial laver as a cohesive agent, for example in a ratio of 4 for industrial laver to 6 for cement is used. Such laver is suspended in water, penetrates along the whole cracks emerging the water leakage, and then expands thereat while it becomes aggregate of cement so that the cement bridge the water leakage portions. Furthermore, even if the cohesive agent penetrates into an underground water during the cut-off water work, it never becomes a factor of pollution as found in other conventional organic accelerating agent.

Some successful examples according to the cut-off water method for a concrete underground structure of the present invention will be now described.

EXAMPLE 1

A normal portland cement powder mixed with sodium bicarbonate of 10% by weight was filled up, and compacted by an electric pick hammer as an impacting tool, which operation was repeated three times, whereby the amount of totally used cement was 550 g and the cut-off water work was accomplished, and successful.

EXAMPLE 2

Jet cement as a super early strength cement was used, filled up, and compacted by an electrical pick hammer, which operation was repeated three times, whereby the amount of totally used cement was 500 g, and thereafter finished in even surface level of concrete wall by a trowel. As a result, any water leakage could not recognized thereafter.

EXAMPLE 3

After injection of a cement slurry, the valve was shut off, and the cement slurry was allowed to stand for one day. When the projecting end of the pipe was then cut off, unhardened cement in the pipe flowed out therefrom with spring water. After the unhardened cement within the pipe was removed, twelve egg-sized rounded clay masses were pressed into the pipe so as to temporarily interrupt the water leakage before a normal portland cement powder was filled up with the help of a cement filling gun, and the filled cement was compacted with the help of an electric pick hammer, which operation was repeated three times, whereby the amount of totally used cement was 320 g. After the lapse of one day the result of the cut-off water work was observed to be perfect in its cut-off water effect.

EXAMPLE 4

Cement powder mixture, in which a normal portland cement of 70% by weight was mixed with sodium alginate powder of 30% by weight, was filled up into the pipe with the help of a cement filling gun, and the filled cement powder was compacted by an electric pick hammer, further the space of pipe produced by the said operation was filled up with cement powder again, then compacted in the same way, which operation was repeated four times to accomplish consolidation filling, whereby the amount of totally used cement was 600 g. Finally the inner surface of the concrete wall was finished in even surface level of concrete wall by a trowel. As a result no water leakage was recognized at the cut-off water work, so that it's effect could be confirmed to be good.

According to such an method as described above, without any special equipment and material cut-off water work is effectively accomplished only by conventional equipments and materials used usually in civil engineering works, with low cost, and without any releakage of water from the same portion thereafter. Especially, when sodium alginate (industrial layer) is used as a cohesive agent mixed with cement powder, the material is low cost, performs an remarkable effect, and involves no environmental pollution.

Further according to the method of the present invention the step of compacting cement powder mixed with an accelerating agent and a cohesive agent causes a mechano-chemical effect to powder particles so as to enhance the strength of the resulting seal, which contributes to an initial perfect cut-off for water leakage and a subsequent hardening of cement powder gradually absorbing water.

I claim:

1. A water cut-off process for a concrete wall of an underground structure having water-leaking portions, wherein a void is formed between the concrete wall and the ground, said process comprising the following steps:

drilling a through-hole extending from the inside into the outside of the concrete wall of said underground structure at each water-leaking portion thereof;

inserting a pipe into each through-hole, each pipe including a valve;

temporarily interrupting a large amount of water spouting from a discharge end of each pipe by shutting off said valve;

grouting cement slurry under low pressure through each pipe into each through-hole and pushing the cement slurry into the void between said concrete wall and the ground using a grouting pump against the pressure of the leaking water, while mixing an accelerating agent into said cement slurry, allowing the mixture of said cement slurry and said accelerating agent to stand for approximately one day to form a hardened cement layer on a surface of said concrete wall facing the ground where said void is formed;

cutting off the end of said pipe projecting from a surface of said concrete wall away from the ground;

removing unhardened cement from each pipe if water continues to leak therefrom;

packing a mound of a cement powder composition over each water-leaking pipe under pressure using a cement filling gun;

compressing said packed cement power in said pipe and said through-hole by exerting; a strong impacting stress thereon using an impacting tool to consolidate and compact said cement powder composition in said pipe and said through-hole;

repeating the processes of packing and compressing said cement powder composition until said through-hole is filled with said cement powder composition; and leveling off the resulting through-hole with a cement paste.

2. A process as claimed in claim 1, wherein said cement powder composition comprises a cement powder and at least a cohesive filler or an accelerating agent.

3. A process as claimed in claim 2, wherein said cohesive filler is clay.

4. A process as claimed in claim 2, wherein said accelerating agent is sodium alginate powder.

5. A process as claimed in claim 4, wherein said sodium alginate powder is used in the ratio of 30% by weight of sodium alginate to 70% by weight of cement powder.

6. A method for cutting off water leaking through a concrete wall formed on the ground, comprising the steps of:

(a) drilling a through-hole in said concrete wall at each leak site;

(b) fitting a pipe into said through-hole;

(c) feeding cement slurry with a hardening agent into a gap present between said concrete wall and the ground, through said pipe, against water coming out from said pipe, to form a hardened cement layer adhered to a surface of said concrete wall facing the ground;

(d) allowing said cement layer to substantially harden;

(e) cutting off the end of said pipe protruding from said concrete wall;

(f) packing a mound of a cement powder composition over said treated hole from which water continues to leak, after removing unhardened cement from said hole; and (g) compressing said composition into said hole.

7. A process as claimed in claim 6, further comprising the step, in step (f), of filling said hole with a filler prior to placement of said cement powder composition.

8. A process as claimed in claim 6, wherein said cement powder composition includes a hardening auxiliary.

9. A process as claimed in claim 6, further comprising the step, after step (f), of conducting at least once: packing a mound of a cement powder composition over said treated hole and compressing said composition into said hole.

10. A process as claimed in claim 6, further comprising the step, after step (f), of covering and finishing said hole with cement.

* * * * *